United States Patent [19]

Hallstrom, Jr.

[11] 4,433,548

[45] Feb. 28, 1984

[54] COMBINATION INTERNAL COMBUSTION AND STEAM ENGINE

[76] Inventor: Olof A. Hallstrom, Jr., 1920 Hallstrom Rd., Tillamook, Oreg. 97141

[21] Appl. No.: 382,702

[22] Filed: May 27, 1982

Related U.S. Application Data

[63] Continuation of Ser. No. 227,967, Jan. 23, 1981, abandoned.

[51] Int. Cl.[3] ..... F01K 27/00

[52] U.S. Cl. ..... 60/712; 60/618

[58] Field of Search ..... 60/616, 618, 712

[56] References Cited

U.S. PATENT DOCUMENTS

| | | | |
|---|---|---|---|
| 1,339,176 | 5/1920 | Dyer | 60/712 X |
| 2,196,980 | 4/1940 | Campbell | 60/618 |
| 2,671,311 | 3/1954 | Rohrbach | 60/712 X |
| 3,964,263 | 6/1976 | Tibbs | 60/712 X |

FOREIGN PATENT DOCUMENTS

| | | | |
|---|---|---|---|
| 287662 | 7/1950 | Fed. Rep. of Germany | 60/712 |
| 261084 | 3/1926 | United Kingdom | 60/712 |

*Primary Examiner*—Allen M. Ostrager
*Attorney, Agent, or Firm*—Oliver D. Olson

[57] ABSTRACT

Each cylinder of an internal combustion engine is provided with a reciprocative piston and a combustible fuel intake port controlled by an intake valve. A steam generation chamber communicates with the cylinder through a steam inlet port controlled by a steam inlet valve which is opened by steam pressure in the generation chamber. The generation chamber also communicates with a combustible fuel exhaust pipe through a combustible fuel exhaust port controlled by a fuel exhaust valve the opening of which is also accompanied by opening of the steam inlet valve. The steam generation chamber also communicates through a water injection valve and, preferably, a heat exchanger associated with the exhaust pipe, with a source of water under super-atmospheric pressure. A steam exhaust port, controlled by a steam exhaust valve, also communicates the cylinder with a steam condenser the outlet of which communicates with a supply reservoir for the water source.

11 Claims, 6 Drawing Figures

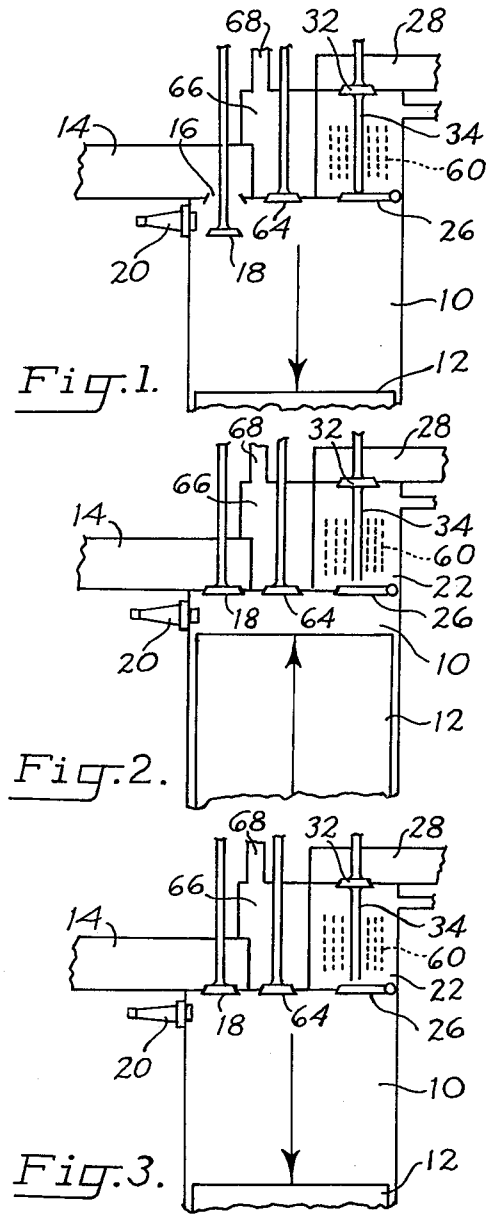
Fig. 1.
Fig. 2.
Fig. 3.
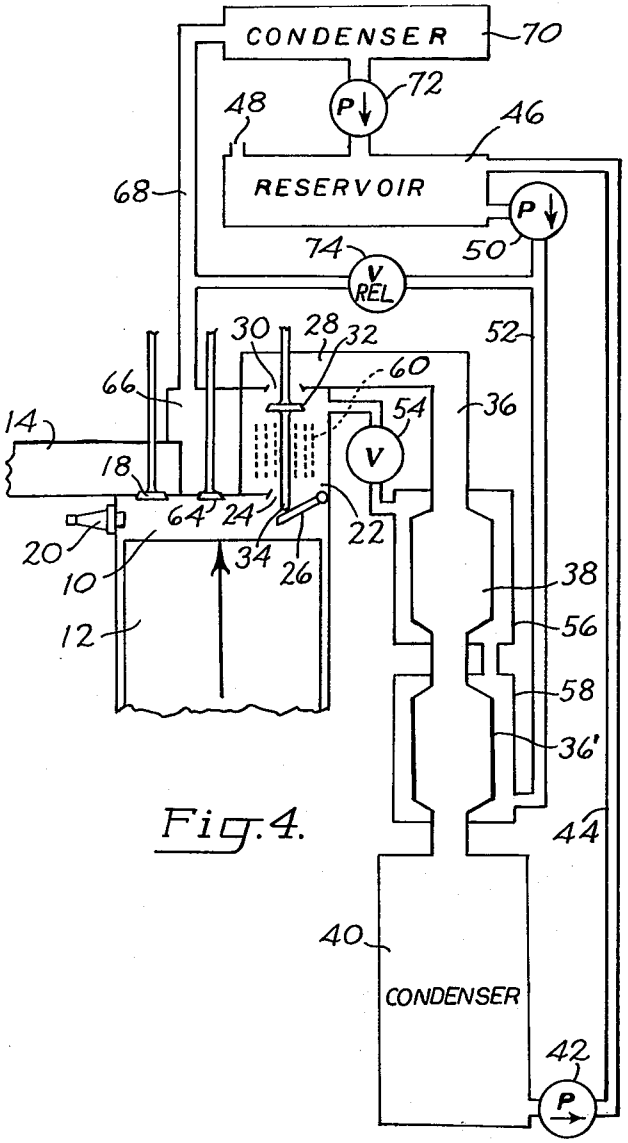
Fig. 4.
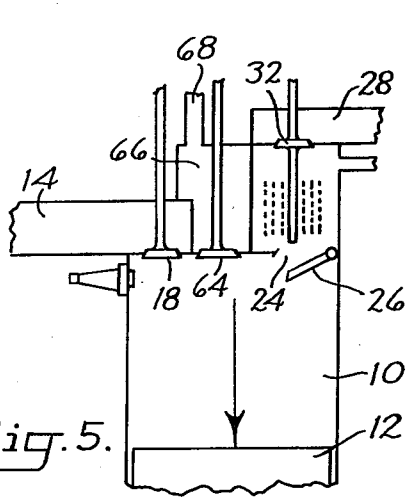
Fig. 5.
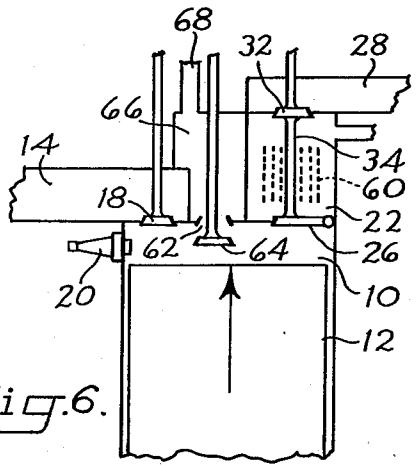
Fig. 6.

COMBINATION INTERNAL COMBUSTION AND STEAM ENGINE

This application is a continuation of application Ser. No. 227,967, filed Jan. 23, 1981, now abandoned.

BACKGROUND OF THE INVENTION

This invention relates to engines, and more particularly to a combination internal combustion and steam engine.

The low operational efficiency of conventional internal combustion engines of the gasoline or diesel type is reflective of the magnitude of the waste of heat of combustion which is exhausted to the atmosphere through the exhaust system and through the water or air cooling system. The low operational efficiency of conventional steam engines is reflective primarily of the magnitude of energy consumed in converting water to steam and in revaporizing condensed steam.

U.S. Pat. No. 1,424,798 discloses an explosive engine wherein steam is produced by mixing pre-heated water directly with a portion of the gases of combustion resulting from the explosion of vaporized fuel in the power stroke of a piston, the steam being isolated from the piston cylinder during its generation and during the combustion power stroke of the piston, and the steam being admitted to the cylinder after the combustion gas is exhausted and the steam allowed to expand to produce a steam-driven power stroke.

This prior patent describes a two cycle engine modified to operate in a four cycle manner. The modification involves complex and costly construction and retains the limitations and disadvantages of conventional two cycle engines. Moreover, its efficiency of operation is reduced significantly by virtue of the power loss resulting from diverting a portion of the gases of combustion from the power stroke for the purpose of direct mixing with water to produce steam.

SUMMARY OF THE INVENTION

In its basic concept, this invention provides a combination internal combustion and steam engine wherein the hot exhaust gases following the power stroke of internal combustion are utilized indirectly to generate steam which, in turn, is utilized to provide a second power stroke, the exhaust steam being condensed for recycling.

It is by virtue of the foregoing basic concept that the principal objective of this invention is achieved; namely, to overcome the aforementioned disadvantages and limitations of prior internal combustion engines, steam engines and combinations thereof, to provide an engine of high operational efficiency.

Another object of this invention is the provision of an engine of the class described in which the exhaust pipe system of the engine is utilized to supply additional heat to the source of water prior to injection into the steam generator, to further improve efficiency of operation.

Still another object of this invention is the provision of an engine of the class described wherein the water vapor component of the combustion gas exhaust in the exhaust pipe is condensed and added to the steam exhaust condensate for recycling, thereby minimizing the size of the water supply storage.

A further object of this invention is the provision of an engine of the class described wherein the exhaust stages of the operating cycle are at sub-atmospheric pressure, thereby providing added output power.

A still further object of this invention is the provision of an engine of the class described which is of simplified construction for economical manufacture.

The foregoing and other objects and advantages of this invention will appear from the following detailed description, taken in connection with the accompanying drawing of a preferred embodiment.

BRIEF DESCRIPTION OF THE DRAWING

FIG. 1 is a fragmentary view in schematic form of a cylinder of a combination internal combustion and steam engine embodying the features of this invention, the components being arranged to depict the combustion fuel intake stage of the operating cycle.

FIG. 2 is a fragmentary view similar to FIG. 1 showing the components arranged to depict the combustion fuel compression and ignition stage of the operation cycle.

FIG. 3 is a fragmentary view similar to FIG. 1 showing the components arranged to depict the combustion fuel power stroke stage of the operating cycle.

FIG. 4 is a fragmentary view similar to FIG. 1 showing the components arranged to depict the combustion fuel exhaust stage of the operating cycle, the view also showing the additional components of the steam assembly.

FIG. 5 is a fragmentary view similar to FIG. 1 showing the components arranged to depict the steam generation and power stroke stage of the operating cycle.

FIG. 6 is a fragmentary view similar to FIG. 1 showing the components arranged to depict the steam exhaust stage of the operating cycle.

DESCRIPTION OF THE PREFERRED EMBODIMENT

For simplicity of description, the drawing illustrates one cylinder of an engine which may include any desired number of cylinders. It also illustrates the engine to be supplied with a mixture of gasoline and air through a carburetor system for ignition by a spark plug. It will be apparent, however, that the engine may be of the type supplied with gasoline or diesel fuel through conventional injection mechanism.

As illustrated, the metal mass of the engine houses a hollow cylinder 10 in which a piston 12 is reciprocative. It is understood that the piston is connected in conventional manner to a crank shaft from which output power is to be delivered to any desired load.

Means is provided for introducing combustible fuel into the cylinder. As illustrated, an intake passageway 14, in the form of a conventional manifold, is connected at its inlet to a conventional carburetor wherein gasoline and air are mixed. A combustible fuel intake port 16 communicates the passageway with the cylinder, and this intake port is opened and closed on a prescribed timed sequence as by means of a cam-operated intake valve 18. The combustible fuel intake stage of the operating cycle occurs when the intake valve is open and the piston moves to its outward position shown in FIG. 1.

As previously mentioned, the illustrated embodiment includes a spark plug 20 which functions in conventional manner to provide an electric spark discharge for igniting the combustible fuel mixture. This occurs after the intake valve has closed and the fuel mixture has been compressed by movement of the piston to its inwardmost position illustrated in FIG. 2. This is the combustible fuel compression stage of the operating cycle.

Upon ignition of the fuel mixture, the expanding gases of combustion drive the piston outward (FIG. 3), producing the combustion fuel power stroke stage of the operating cycle.

The next stage in the operating cycle is the exhausting of the gases of combustion from the cylinder by movement of the piston to its inwardmost position illustrated in FIG. 4.

The inner end of the cylinder communicates with a steam generation chamber 22 through a steam inlet port 24. The port is opened and closed by a steam inlet valve 26 which normally is urged to its closed position, as by means of spring loading.

The end of the steam generation chamber opposite the steam inlet port communicates with a combustion gas exhaust passageway 28, such as an exhaust manifold, through an exhaust port 30. The exhaust port is opened and closed on a prescribed timed sequence as by a cam-operated combustion gas exhaust valve 32.

An extension 34 of the combustion gas exhaust valve projects through the steam generation chamber 22 for releasable engagement with the steam inlet valve 26. It is dimensioned so that when the exhaust valve 32 is moved to open the exhaust port, the extension also moves the steam inlet valve to the position opening the steam inlet port 24.

The exhaust manifold or other passageway 28 is connected to one end of an exhaust pipe 36. If desired or required, the exhaust pipe may communicate with a catalytic converter 38 and thence to the atmosphere, in conventional manner.

In the preferred embodiment illustrated, the outlet end of the exhaust pipe communicates with the inlet of a condenser 40 which functions to condense the water vapor component of the combustible fuel exhaust gases. The condensate is delivered, by means of a pump 42 and delivery pipe 44, to a water reservoir 46.

The reservoir is provided with a gas outlet 48 by which to vent exhaust gases to the atmosphere. The reservoir serves as storage for a supply of water to be injected to the steam generator chamber 22, on a prescribed timed sequence, for the generation of steam. For this purpose the inlet of a pump 50 communicates with the water reservoir and the outlet of the pump communicates through a delivery pipe 52 to the inlet of an injection valve 54 the outlet of which communicates with the steam generation chamber.

The injection valve is opened and closed on a prescribed timed sequence by any conventional means. It will be understood that this valve is normally closed and is opened after the exhaust valve 32 has moved to close the exhaust port following the combustion gas exhaust stage of the operating cycle. Also, the injection valve is maintained in the closed position until the engine has reached a predetermined elevated temperature of operation. In this regard, it will be understood that the cold engine is started only by using the combustion fuel stages of the operating cycle.

In the preferred embodiment illustrated, means is provided for preheating the water prior to injection into the steam generation chamber 22, in order to maximize the efficiency of operation. For this purpose a heat exchanger is interposed in the delivery pipe 52 between the pump 50 and metering valve 54. As illustrated, the heat exchanger is formed in two segments, one segment 56 surrounding the catalytic converter 38 and the other segment 58 surrounding an enlarged portion 36' of the exhaust pipe. This portion of the exhaust pipe, as well as the catalytic converter, are enlarged relative to the exhaust pipe in order to provide maximum heat exchange surface, as will be understood.

The steam generation chamber 22 contains a quantity of heat conductive material, such as a coil 60 of heat conductive metal which provides substantial heat transfer surface. This heat conductive material absorbs the heat from the gases of combustion being exhausted through the steam generation chamber to the exhaust pipe. Accordingly, the water, preferably preheated as described, injected into the steam generator chamber is flashed instantly to steam by transfer of heat to the water from the heat conducting surfaces in the chamber.

A steam exhaust port 62 in the inner end of the cylinder is opened and closed on a prescribed timed sequence by means of a steam exhaust valve 64. In the preferred embodiment illustrated, means is provided for recovering the steam exhaust for recycling, and to this end a steam exhaust passageway 66, in the form of a manifold, communicates the steam exhaust port with a steam exhaust conduit 68. This conduit delivers the steam exhaust to the inlet of a condenser 70, the outlet of which communicates with an inlet of a pump 72. The outlet of the pump delivers the condensate to the water reservoir 46.

A relief valve 74 is interposed between the outlet of the pump 50 and the steam exhaust conduit 68. It functions to divert the outlet of the pump to the steam conduit in the even the pressure at the pump outlet exceeds a predetermined maximum.

As previously explained, FIG. 4 illustrates the arrangement of components for exhausting the gases of combustion from the cylinder 10 to the exhaust pipe 36. Upon completion of this stage, the combustion gas exhaust valve 32 closes the exhaust port 30, as illustrated in FIG. 5. At this time the water injection valve 54 opens momentarily to inject water into the steam generation chamber, under the superatmospheric pressure provided by the pump 50.

The expanding steam within the chamber 22 forces the steam inlet valve 26 open and enters the cylinder under high pressure, driving the piston outward to the position illustrated in FIG. 5. This is the steam power stroke stage of the operating cycle.

Upon completion of the steam power stroke stage, the steam exhaust valve 64 opens to allow the steam to exhaust through the steam exhaust manifold 66 and conduit 68, as the piston moves to its inwardmost position illustrated in FIG. 6. As previously explained, the exhaust steam is delivered to the condenser 70 and the resulting condensate returned to the water reservoir 46 through the pump 72.

It is to be noted that the pumps 42 and 72 and the condensation effected by the associated condensers 40 and 70 operate to create a sub-atmospheric pressure at the combustion gas exhaust port 30 and steam exhaust port 62, respectively. Accordingly, during both of these exhaust stages of the operating cycle, the cylinder 10 is at sub-atmospheric pressure. As a consequence, the piston 12 is being pushed inward by atmospheric pressure at the outer end of the piston. This contributes additional output power at the crank shaft of the engine.

Further, the steam exhaust stage serves to scavenge the cylinder of residuals from the combustion stage, whereby to further improve the efficiency of operation of the engine.

From the foregoing it will be appreciated that the present invention provides an engine in which the heat of combustion normally wasted in conventional internal combustion engines is utilized to generate steam for a steam power phase of operation and to minimize condensation of the steam during the working portion of the steam phase. Recovering the steam exhaust and condensing it for recycling minimizes the requirement for water storage. Further, condensing the water vapor component of the combustion gas exhaust and returning it to the water storage further minimizes the water storage requirement. These factors and others described hereinbefore contribute to the provision of an engine of simplified construction for economical manufacture and minimum maintenance, while providing maximum operating efficiency.

It will be apparent to those skilled in the art that various changes may be made in the size, shape, type, number and arrangement of parts described hereinbefore, without departing from the spirit of this invention.

Having now described my invention and the manner in which it may be used, I claim:

1. A combination internal combustion and steam engine, comprising:

(a) a housing having therein at least one hollow cylinder containing a piston reciprocative therein, (b) means for introducing combustible fuel into the cylinder to provide a combustible fuel power stroke for the piston, (c) an exhaust passageway for exhausting hot gases of combustion from the cylinder after the combustible fuel power stroke, (d) a steam generating chamber in the housing communicating at one location with the cylinder and at another location with the exhaust passageway, whereby hot gases of combustion in the cylinder are caused to pass through and heat the surfaces of the steam generating chamber on their way to the exhaust passageway, (e) a source of water communicating with the steam generating chamber for supplying water to said chamber for conversion into steam by transfer of heat to the water from the hot surfaces of the chamber, (f) an exhaust valve between the steam generating chamber and exhaust passageway operable to open communication between the steam generating chamber and the exhaust passageway for exhausting hot gases of combustion from the cylinder and to close said communication during generation of steam in the chamber, (g) a steam inlet valve between the steam generating chamber and cylinder operable when the exhaust valve is open to open communication between the steam generating chamber and the cylinder for exhausting hot gases of combustion from the cylinder through the chamber to the exhaust passageway, and operable when the exhaust valve is closed to open communication between the steam generating chamber and cylinder for introducing steam from the chamber to the cylinder to provide a steam power stroke for the piston, and (h) a valve-controlled steam exhaust passageway communicating with the cylinder independently of the steam generating chamber for exhausting the cylinder of steam after the steam power stroke.

2. The combination of claim 1 wherein the steam inlet valve is operable by steam pressure in the steam generating chamber to communicate said steam pressure to the cylinder.

3. The combination of claim 2 including actuator means associated with the combustion gas exhaust valve and steam inlet valve for opening and closing the steam inlet valve simultaneously with opening and closing the combustion gas exhaust valve while allowing the steam inlet valve to open under steam pressure in the steam generating chamber when the combustion gas exhaust valve is closed.

4. The combination of claim 1 wherein the source of water includes steam condensing means interposed between the steam exhaust passageway and the steam generating chamber for condensing the steam exhaust for return of the condensate to the steam generating chamber.

5. The combination of claim 4 including a condensate reservoir interposed between the steam condensing means and the steam generating chamber, and pump means between the steam condensing means and condensate reservoir for producing a sub-atmospheric pressure at the cylinder.

6. The combination of claim 4 including a condensate reservoir interposed between the steam condensing means and the steam generating chamber, and pump means between the condensate reservoir and the steam generating chamber for injecting water into the steam generating chamber at superatmospheric pressure.

7. The combination of claim 4 including a condensate reservoir interposed between the steam condensing means and the steam generating chamber, and pump means between the steam condensing means and condensate reservoir for producing a sub-atmospheric pressure at the cylinder, and pump means between the condensate reservoir and the steam generating chamber for injecting water into the steam generating chamber at superatmospheric pressure.

8. The combination of claim 4 wherein the combustion gas exhaust passageway includes an exhaust pipe, and a heat exchanger is interposed between the steam condensing means and the steam generating chamber and is in heat conductive relationship with the exhaust pipe, for transferring heat from the hot exhaust gases to the condensate.

9. The combination of claim 8 wherein the source of water includes water vapor condensing means interposed between the outlet end of the exhaust pipe and the steam condensing means for condensing the water vapor component of the combustion gas exhaust for return of the condensate to the steam generating chamber.

10. The combination of claim 1 wherein the combustion gas exhaust passageway includes an exhaust pipe, and a heat exchanger is interposed between the steam condensing means and the steam generating chamber and is in heat conductive relationship with the exhaust pipe for transferring heat from the hot exhaust gases to the condensate, and the source of water includes water vapor condensing means interposed between the outlet end of the exhaust pipe and the steam generating means for condensing the water vapor component of the combustion gas exhaust for return of the condensate to the steam generating chamber.

11. The combination of claim 10 including a condensate reservoir interposed between the water vapor condensing means and the steam generating chamber, and pump means between the water vapor condensing means and condensate reservoir for producing a sub-atmospheric pressure at the cylinder.

* * * * *